US005274890A

United States Patent [19]

Shimizu et al.

[11] Patent Number: 5,274,890

[45] Date of Patent: Jan. 4, 1994

[54] SEAT BELT TONGUE RETAINING DEVICE

[75] Inventors: Hideki Shimizu; Kazuo Seze; Takahiro Yamanishi, all of Shiga, Japan

[73] Assignee: Takata Corporation, Tokyo, Japan

[21] Appl. No.: 995,371

[22] Filed: Dec. 23, 1992

[30] Foreign Application Priority Data

Jan. 10, 1992 [JP] Japan ..... 4-3073

[51] Int. Cl.[5] ..... A44B 11/00

[52] U.S. Cl. ..... 24/603; 24/633

[58] Field of Search ..... 24/603, 602, 606, 633, 24/588, 303; 244/122; 200/61.58; 280/801; 297/470

[56] References Cited

U.S. PATENT DOCUMENTS 3,146,846 9/1964 Gutshall ..... 24/603
3,311,188 3/1967 Gutshall ..... 24/603
4,126,919 11/1978 Lassche ..... 24/602
4,339,854 7/1982 Ikesue ..... 200/61.58 B
4,644,616 2/1987 Ferry ..... 24/603
5,113,556 5/1992 Murai et al. ..... 24/633

*Primary Examiner*—Victor N. Sakran
*Attorney, Agent, or Firm*—Kanesaka and Takeuchi

[57] ABSTRACT

A seat belt tongue retaining device which comprises a buckle unit having an insertion passage into which a tongue is inserted, and a latch pawl capable of getting into and out of the insertion passage. A tongue has a latch hole for allowing the latch pawl to engage therewith. Slots formed in the tongue extend in the inserting direction. Arms disposed turnably in the buckle unit have leading ends capable of protruding and moving in the tongue inserting direction. The arms engage with the slots of the tongue in the insertion passage and pull the tongue deep into the passage wherein the tongue is latched automatically.

8 Claims, 10 Drawing Sheets

SEAT BELT TONGUE RETAINING DEVICE

BACKGROUND OF THE INVENTION

1. Field of the Invention

The present invention relates to a device for retaining a tongue of a seat belt which is disposed in a vehicle for protecting an occupant. More particularly, the present invention relates to a seat belt tongue retaining device having a buckle unit equipped with a mechanism for pulling the tongue thereinto.

2. Description of the Related Art

A seat belt system is constructed to restrain an occupant on a seat of a vehicle with a seat belt by inserting a tongue of the seat belt into a buckle disposed at a side of the seat and by latching the tongue with a latching device.

In the seat belt system of the prior art, the occupant has to grip the tongue by his or her hand and to push it deep into the buckle. For these operations, however, the occupant has to push the buckle with an upper half of his or her body being twisted sideways, whereby he or she is uncomfortable in his or her upper half body.

OBJECT AND SUMMARY OF THE INVENTION

A seat belt tongue retaining device of the first mode of the present invention comprises a buckle unit having an insertion passage into which a tongue is inserted, and a latch pawl capable of getting into and out of the insertion passage. The tongue has a latch hole for allowing the latch pawl to engage therewith, and a slot extending in the inserting direction. The device includes one or two arms disposed turnably in the buckle unit. The arm has a leading end capable of protruding and moving in the tongue inserting direction around its base end. The arm is engageable with the slot of the tongue in the insertion passage. The device comprises further a driving device for turning the arm in the tongue inserting direction.

According to a second mode, a seat belt tongue retaining device according to the first mode, further comprises a first sensor for detecting the leading end of the tongue inserted into the entrance of the insertion passage, a second sensor for detecting that the tongue has been inserted into a latch position, and actuating device for actuating the driving device in response to a detection signal of the first sensor and for stopping the driving device in response to a detection signal of the second sensor.

According to a third mode, in a seat belt tongue retaining device according to the second mode, the driving device includes a solenoid having its iron core capable of moving, when energized, in the tongue inserting direction, link slots formed in the arms and extending in the longitudinal directions of the arms, and a link engaging with the link slots and moved back and forth in the tongue inserting direction by the iron core of the solenoid.

According to a fourth mode, a seat belt tongue retaining device according to one of the first to third modes, further comprises a latch releasing device driven by the driving device for retracting the latch pawl out of the insertion passage.

According to a fifth mode, in a seat belt tongue retaining device according to the third mode, the latch releasing device includes a lever extending from the latch pawl, a cam wheel engaged by the leading end of the lever for moving the latch pawl back and forth relative to the tongue insertion passage through the lever, and a pitch mechanism for associating the iron core of the solenoid and the cam wheel to rotate the cam wheel by a predetermined angle for each stroke of the iron core thereby to switch the forward and backward movements of the latch pawl into and out of the tongue insertion passage for the each stroke.

According to a sixth mode, in a seat belt tongue retaining device according to the fifth mode, the pitch mechanism includes: pins formed on the cam wheel in circumferentially equal-distant positions; and a feed rod having its one end pivoted to the link and the other end formed with a pawl engaging with one of said pins.

According to a seventh mode, a seat belt tongue retaining device according to the first to sixth modes further comprises a manual latch releasing mechanism for retracting the latch pawl manually from the tongue insertion passage.

In the buckle of the seat belt system according to the first mode, when a tongue is inserted at the leading end thereof into the slit of the buckle unit, the arms are turned to bring their leading ends into engagement with the slots of the tongue. Then, the tongue is pulled into the buckle until it is latched by the latching device. Thus, the tongue can be inserted into the buckle when the occupant pushes the tongue only into an entrance portion of the buckle.

In the seat belt tongue retaining device of the second mode, the tongue pull-in operation when the sensor detects the tongue.

According to the seat belt tongue retaining device of the third mode, the tongue is inserted into the buckle by the solenoid.

According to the seat belt tongue retaining device of the fourth mode, the latch can be released by actuating the driving device, and the device can be operated by remote control.

According to the seat belt tongue retaining device of the fifth mode, the cam wheel is rotated by a stroke of the iron core of the solenoid to bring the latch pawl into and out of the insertion passage through the lever engaging with a cam face of the cam wheel. When the cam wheel rotates by one pitch of the pitch mechanism, forward and backward movements of the latch pawl into the insertion passage are switched.

According to the seat belt tongue retaining device of the sixth mode, when the iron core of the solenoid is subjected to the stroke, the feed rod is moved back and forth so that the cam wheel is rotated by the distance corresponding the pin pitch for each stroke of the iron core.

According to the seat belt tongue retaining device of the seventh mode, the latch can be released by retracting the latch pawl manually from the insertion passage.

BRIEF DESCRIPTION OF THE DRAWINGS

FIG. 6(*b*) is a perspective view of a latch spring;

DESCRIPTION OF THE PREFERRED EMBODIMENTS

An embodiment of the present invention will be described in the following with reference to the accompanying drawings.

Figure 2:
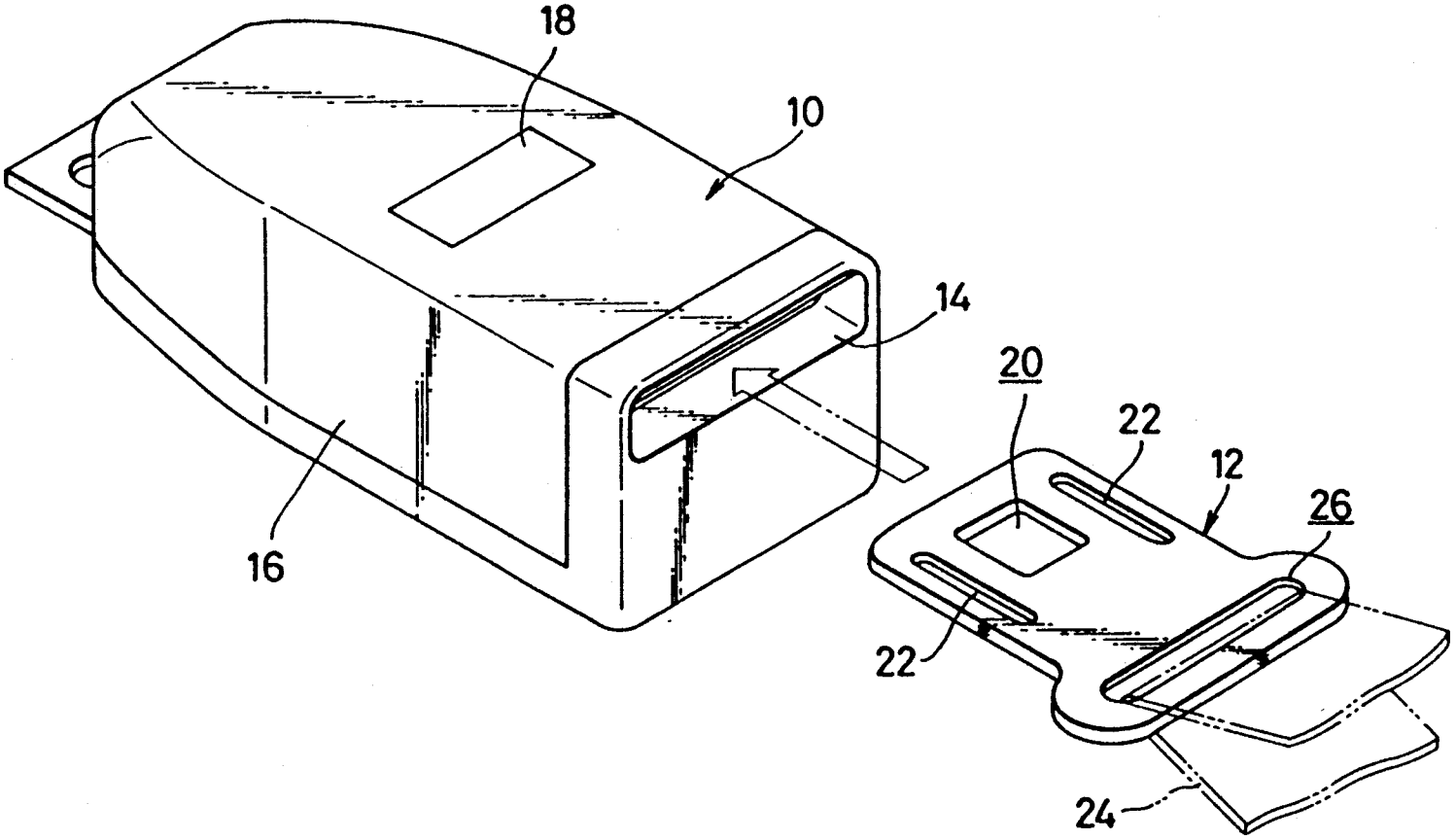
FIG. 2 is a perspective view showing the entire construction of the device of the embodiment.

As shown in FIG. 2, a seat belt tongue retaining device according to the present embodiment has a buckle unit 10 and a tongue 12. The buckle unit 10 is composed of a slit 14 for inserting the tongue 12, a mechanism (as will be described in detail later) for pulling the tongue 12 forcibly into a passage leading from the slit 14, a cover 16 covering the mechanism and a push button 18 for releasing a latch manually.

The tongue 12 is provided with a latch hole 20 of a rectangular hole to be engaged by a latch pawl in the buckle unit 10, arm slots 22 to be engaged by the leading ends of arms in the buckle unit 10 and a belt slot 26 for inserting a seat belt 24. The slots 22 are formed in the two sides of the tongue 12 so as to extend in the inserting direction.

A forcible tongue pull-in mechanism in the buckle unit 10 will be described in the following with reference to FIG. 1. A frame 30 is formed at its one end with a flat plate, on which is fixed a solenoid 32. The flat plate has at its leading end an anchoring portion 34 for anchoring the buckle unit 10 to a car body. The anchoring portion 34 is provided with a bolt hole 34A for anchoring the buckle unit 10 therethrough on a car body. Along the frame 30, as shown in FIGS. 5 and 7, there is formed a passage for taking the tongue 12 thereinto.

Figure 3:
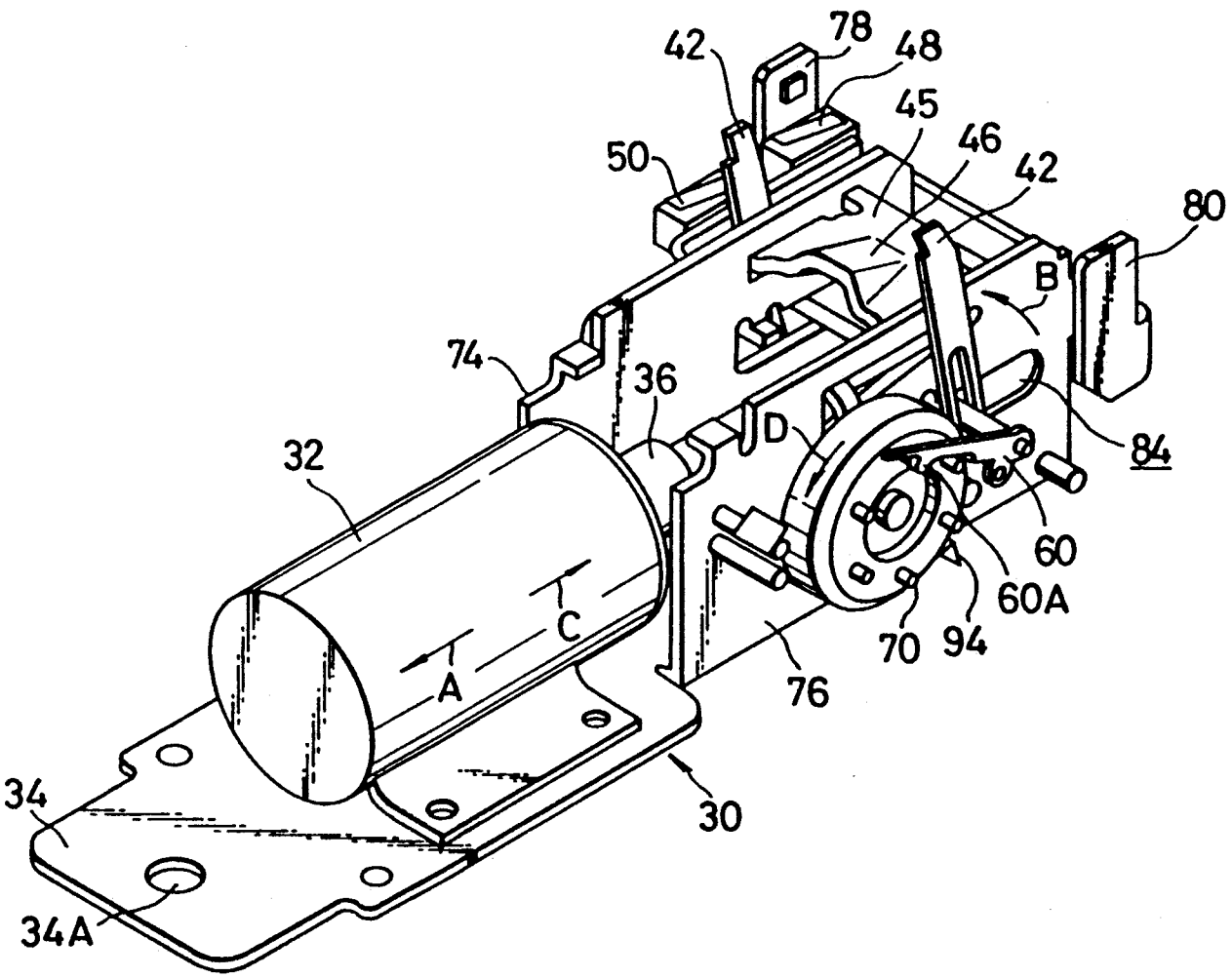
FIG. 3 is a perspective view of an internal structure of the device and shows a tongue pull-in operation.
Figure 4:
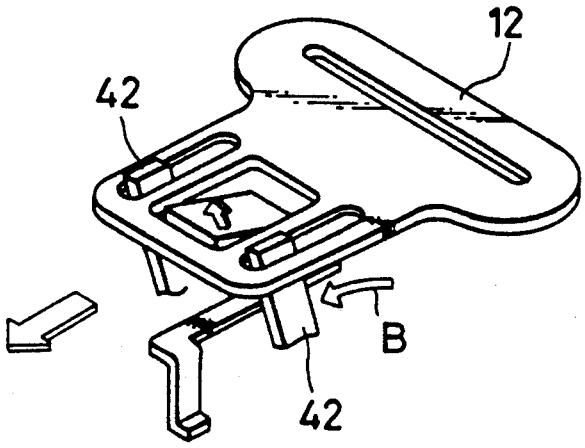
FIG. 4 is a perspective view showing arms and a tongue for explaining the tongue pull-in operation.

The iron core 36 of the pull-in solenoid 32 is fixed with a connecting rod 38. The rod 38 is equipped at its leading end with a link 40 extending perpendicularly to the stroke direction of the iron core 36. The link 40 engages with slots 44 of a pair of arms 42 and 42. The link 40 is moved in the direction of arrow A of FIG. 1 when the iron core 36 is pulled in the direction of arrow A, whereby the arms 42 is turned in the direction of arrow B, as shown in FIG. 3. These arms 42 have their leading ends engaging with the slots 22 of the tongue 12 to pull the tongue 12 forcibly into the buckle unit 10.

Figure 5:
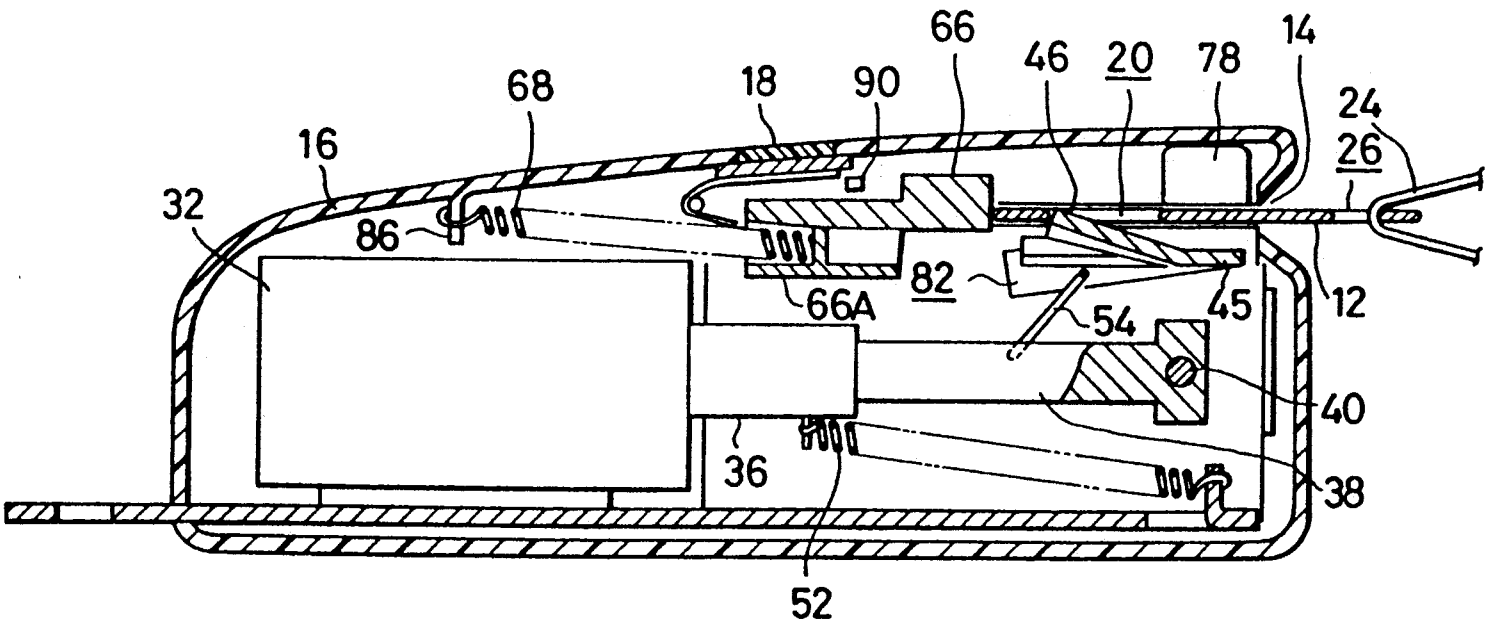
FIG. 5 is a longitudinal section showing the device of the embodiment.
Figure 7:
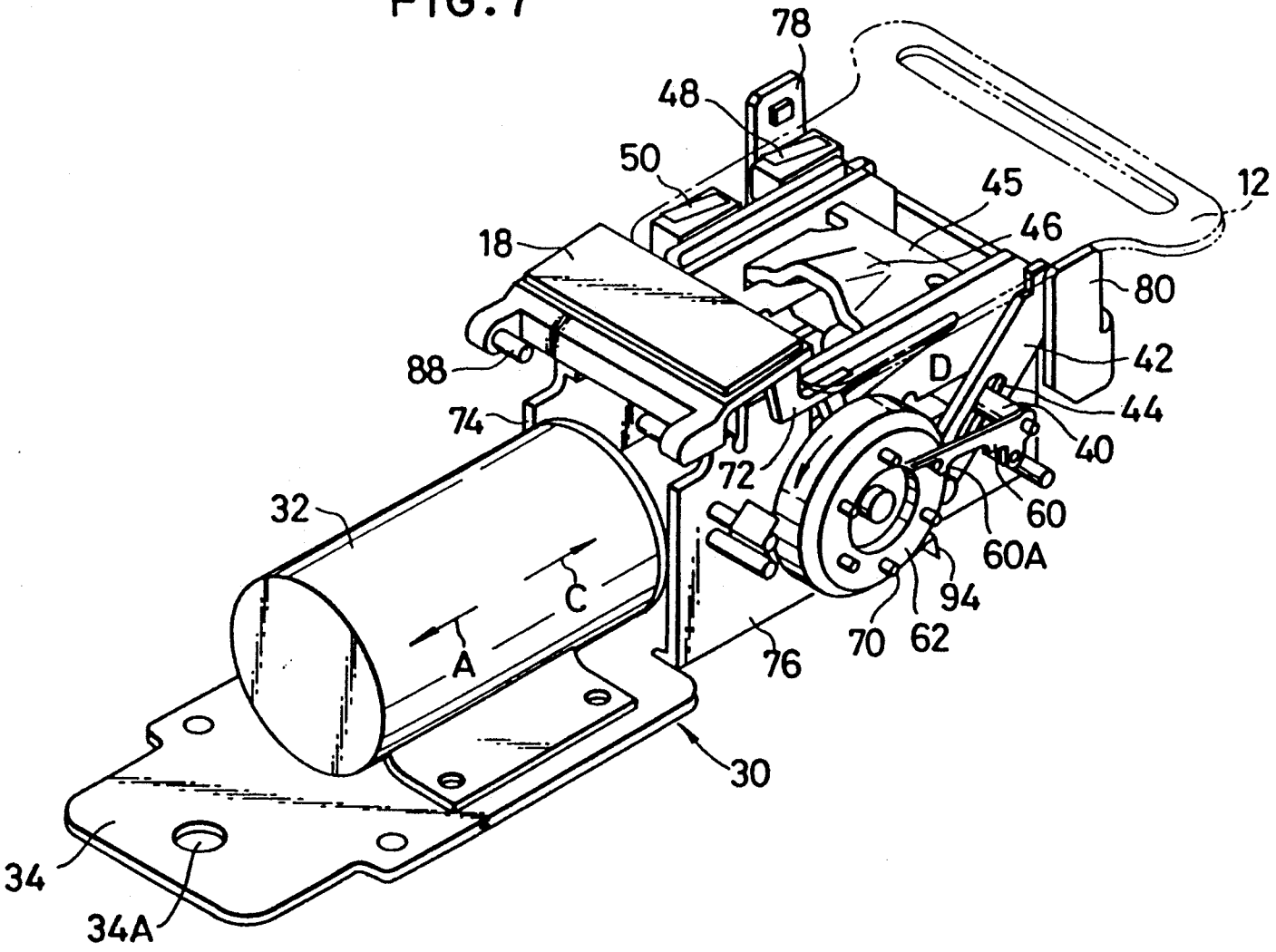
FIG. 7 is a perspective view showing a tongue pull-in state.

When the tongue 12 is inserted deep into the buckle unit 10, as shown in FIGS. 5 and 7, the latch hole 20 of the tongue 12 engages with a latch pawl 46, so that the tongue 12 is latched. The latch pawl 46 is raised from a latch plate 45.

The buckle unit 10 is equipped therein with a first limit switch 48 in the vicinity of the slit 14. As the leading end of the tongue 12 is inserted into the leading end of the slit 14, the solenoid 32 is energized in response to a detection signal of the limit switch 48, and the arms 42 are turned to pull the tongue 14 forcibly deep, as described above. When the tongue 12 has its leading end pulled in deep and latched, the leading end thereof is detected by a second limit switch 50, and the solenoid 32 is deenergized. Then, the iron core 36 and the connecting rod 38 are returned in the direction of arrow C by being forced by a return spring 52 (shown in FIG. 5) connected to the connecting rod 38, so that the turning arms 42 also restore the positions shown in FIG. 1.

Figure 6A:
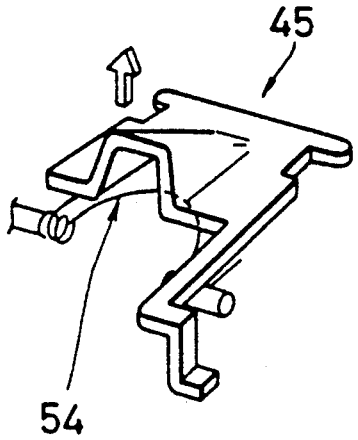
FIG. 6(*a*) is a perspective view showing a latch plate.
Figure 6B:
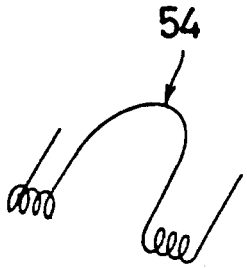

Below the latch plate 45, as shown in FIG. 6(*a*), there is provided a latch spring 54 for biasing the latch plate 45 in a direction for the latch pawl 46 to more into the insertion passage of the tongue 12. As a result, even if the arms 42 are returned to the position shown in FIG. 1, the latch pawl 46 is held in the state in which it entered the insertion passage, so that the tongue 12 is left latched.

Figure 12:
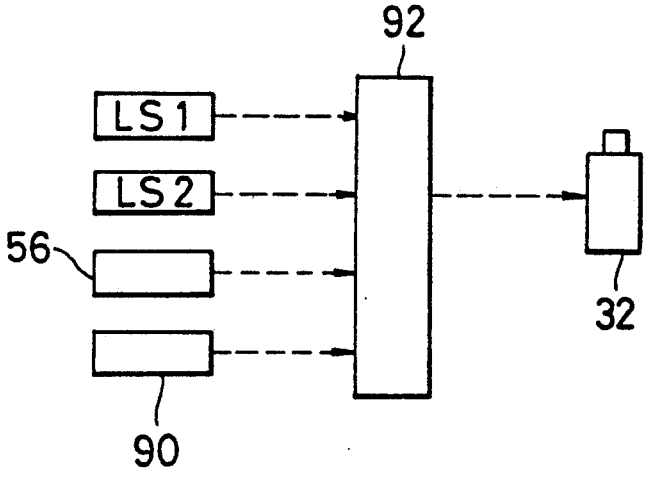
FIG. 12 is a flow chart of a control system of the buckle unit.

In the latched state of the tongue 12 as shown in FIGS. 5 and 7, when a release switch 56 (which is mounted on the instrument panel, for example, as shown in FIG. 12) is pushed, the solenoid 32 is energized again, so that the iron core 36, the connecting rod 38 and the link 40 are moved in the direction of arrow A. In accordance with this, a cam wheel 62 is rotated through a feed rod 60 so that a lever 63 provided at the latch plate 45 is pulled downward in FIG. 9. As a result, the latch pawl 46 is pulled downward of FIG. 1 and retracted from the insertion passage of the tongue 12. Then, an ejector 66 arranged deep in the insertion passage, as shown in FIG. 5, is moved in the direction of arrow C (i.e., rightward of FIG. 5) by the action of a push-out spring (or compression coil spring) 68 so that the tongue 12 is pushed out of the buckle unit 10.

Figure 9:
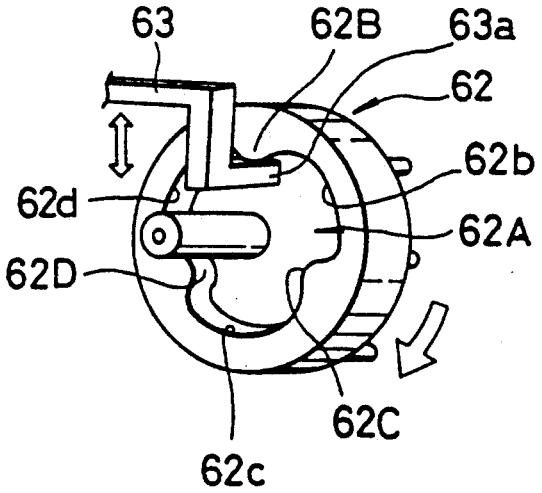
FIG. 9 is a perspective view showing a cam wheel.
Figure 10:
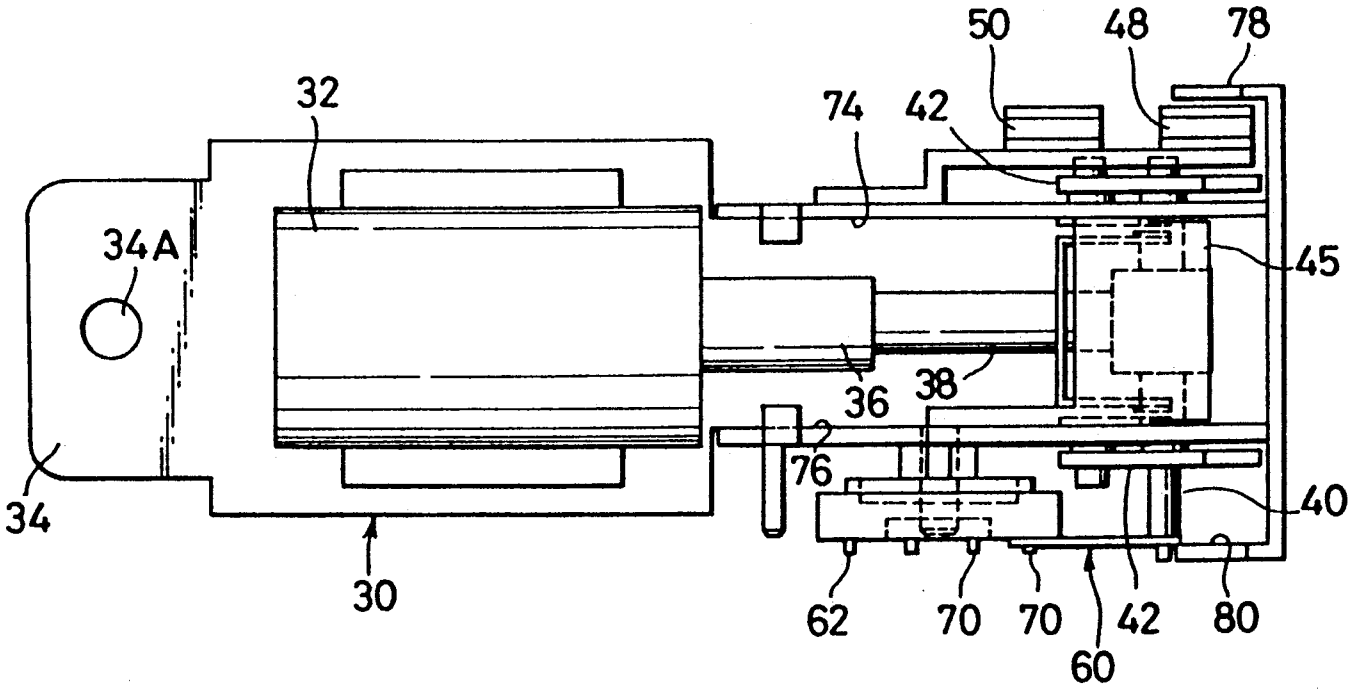
FIG. 10 is a top plan view for explaining the internal construction of a buckle unit according to the embodiment.
Figure 11:
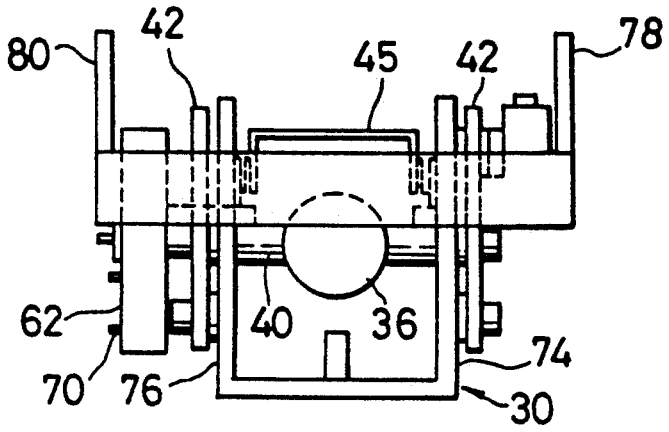
FIG. 11 is a front elevation for explaining an internal construction of the buckle unit.

As shown in FIG. 9, the cam wheel 62 is provided in its back with a cam groove 62A which is recessed in a shape similar to a circle. The cam groove 62A is provided in its inner circumference with three cam crests 62B, 62C and 62D which are located in circumferentially trisectional positions, thus leaving cam troughs 62*b*, 62*c* and 62*d* between those crests. When the pawl 63*a* engages with one of the cam crests 62B, 62C and 62D, the lever 62 is pulled down to retract the latch pawl 46 of the latch plate 45 out of the tongue insertion passage. On the other hand, when the pawl 63*a* of the lever 63 engages with one of the cam troughs 62*b*, 62*c* and 62*d*, the latch pawl 46 is located in the tongue insertion passage.

Figure 1:
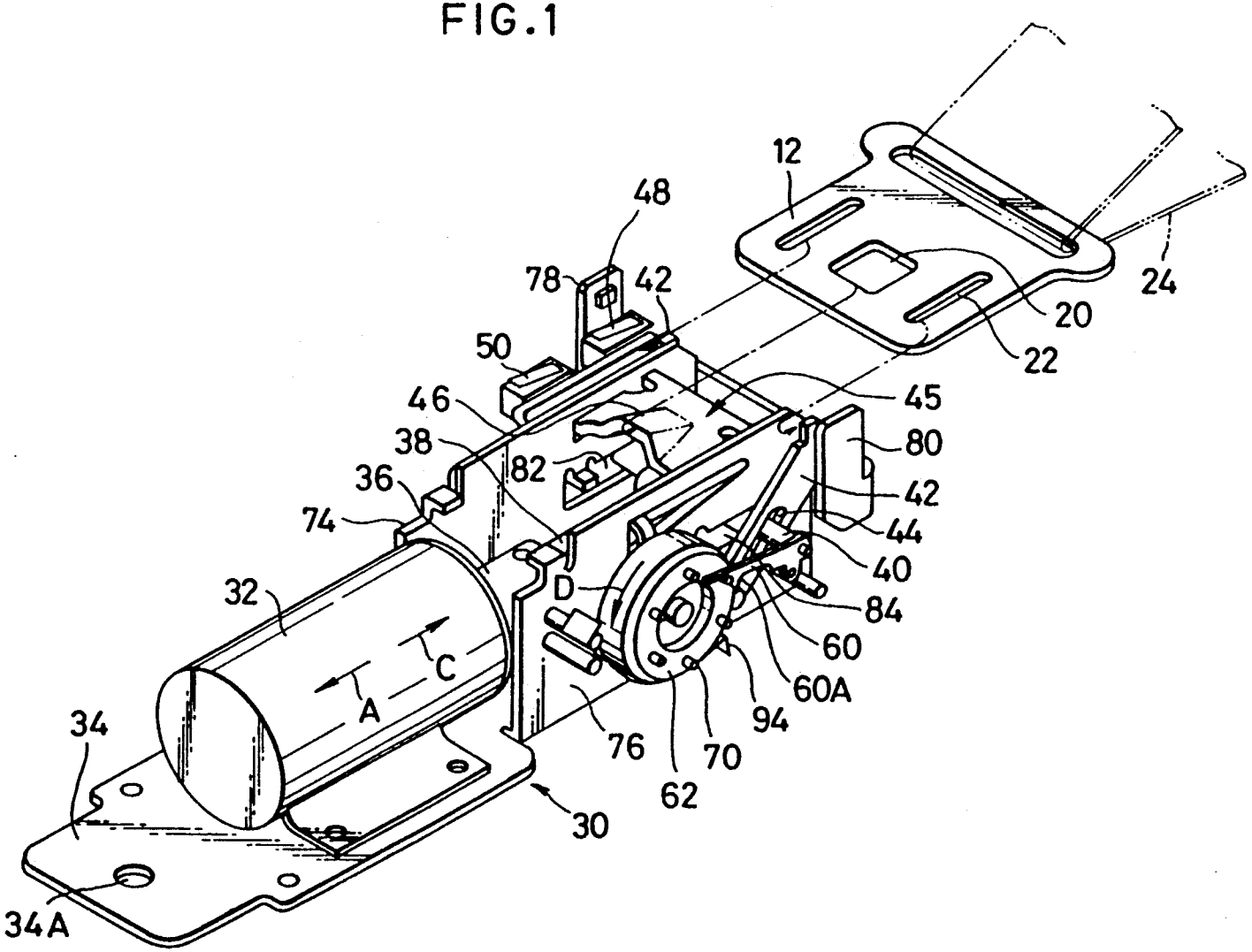
FIG. 1 is a perspective view showing an internal construction of a device according to an embodiment of the present invention.

As shown in FIGS. 1, 3 and 7, the cam wheel 62 is in its circumferentially hexasectinal positions provided with totally six pins 70, one of which is to be engaged by a pawl 60A at the leading end of the aforementioned feed rod 60. As a result, when the feed rod 60 is pushed in the direction of arrow A by the link 40, the cam wheel 62 is rotated by 60 degrees about its axis in the direction of arrow D.

As described above, when only a head end of the tongue 12 is inserted into the slit 14 of the buckle unit 10, the tongue 12 is automatically pulled into the passage and latched by the buckle unit 10. When the release switch 56 (shown in FIG. 12) is then operated, the latch is released so that the tongue 12 is pushed out of the buckle unit 10.

When the push button 18 is depressed, a release lever 72 connected to the push button 18 depresses the lever 63 so that the latch pawl 46 is retracted from the tongue insertion passage to release the latch.

The tongue pull-in mechanism of the present embodiment will be described in more detail in the following.

The frame 30 is equipped with a pair of side plates 74 and 76, inside of which are arranged the connecting rod 38, the latch plate 45 and so on. The insertion passage of the tongue 12 is formed along the upper end faces of those side plates 74 and 76, and the latch pawl 46 is so arranged that it can protrude from the upper end faces of the side plates 74 and 76.

Figure 8:
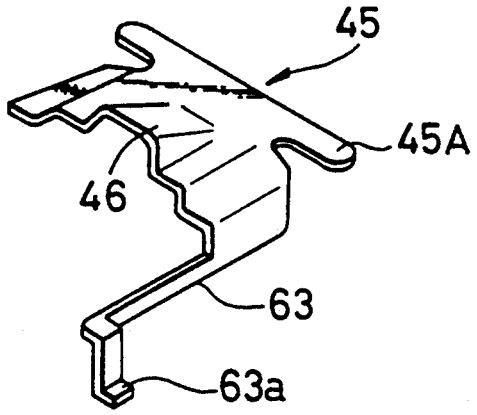
FIG. 8 is a perspective view for explaining a detailed construction of the latch plate.

The latch plate 45 is formed, as shown in FIG. 8, at its base end with a pivot portion 45A which is engaged in pivot holes formed in the side plates 74 and 76. The latch plate 45 can turn on the pivot portion 45A. The frame 30 is integrally provided with tongue guides 78 and 80 for guiding the two side portions of the tongue inserted into the insertion passage.

To the leading end of the connecting rod 38, there is fixed the link 40 which is loosely fitted in slots 82 and 84 formed in both the side plates 74 and 76. The feed rod 60 has its base end pivoted to the leading end portion of the link 40 coming out of the slot 84. The portion of the link 40 outside of the slot 84 is fitted in the slot 44 of the each of the arms 42. The arms 42 have their base ends pivoted to the side plates 74 and 76 so that their leading ends can turn in the direction of arrow B of FIG. 3, as has been described above.

As shown in FIG. 5, the ejector 66 is arranged to slide along the upper end faces of the side plates 74 and 76, and the eject spring 68 has its leading end inserted into a spring holder portion 66A formed in the ejector 66. The eject spring 68 has a rear end thereof retained by a hook portion 86 of the cover 16.

The push button 18 is enabled to turn on a pivot pins 88. A sensor 90 for detecting that the push button 18 is depressed is arranged below the push button 18 as shown in FIG. 5. In case the push button 18 is depressed to move the ejector forward thereby to push out the tongue, the solenoid 32 energized for a short time after the push-out of the tongue 12 so that the connecting rod 38, the link 40 and the feed rod 60 may be once moved in the direction of arrow A to rotate the cam wheel 62 by 60 degrees in the direction of arrow D. The reason why the cam wheel 62 is thus rotated by 60 degrees after the manual latch release is to return the engagement between the cam groove 62A of the cam wheel 62 and the lever 63 to the state before the tongue insertion. This reasoning will be more specifically described in the following. When the tongue 12 is completely inserted, the pawl 63*a* of the lever portion 63 is in engagement with the cam trough 62*b* (or 62*c* or 62*d*). In case of the manual latch release, however, the position of the cam wheel 62 has to be returned to the latch released state by causing the pawl 63*a* to engage with the cam crest 62C (or 62D or 62B).

When the release switch 56 or the sensor 90 is operated while the tongue 12 is not inserted into the buckle unit 10, a signal therefrom is not received by a control unit 92 (shown in FIG. 12), so that the solenoid 32 is left deenergized. In other words, only when the limit switch 50 detects the tongue 12 the solenoid 32 is energized by the release switch 56 or the button sensor 90.

A reference numeral 94 appearing in FIG. 1 designates a frictional leaf spring which is in slidable engagement with the cam wheel 62 to prevent the same from any free rotation.

As has been apparent from the above embodiment according to the seat belt tongue retaining device of the present invention, the tongue is forcibly pulled into the buckle unit even if it is lightly inserted into the passage of the buckle unit. As a result, the tongue need not be pushed deep into the buckle unit, so that it can be retained remarkably easily.

What is claimed is:

1. A seat belt tongue retaining device comprising:

a buckle unit having an insertion passage, and a latch pawl capable of getting into and out of said insertion passage;

a tongue having a latch hole, said tongue being inserted into the insertion passage for allowing said latch hole to engage with said latch pawl;

a slot formed in said tongue and extending in an inserting direction;

an arm for pulling said tongue disposed turnably in said buckle unit, and having a leading end capable of protruding and moving in the tongue inserting direction, a base end about which the arm is rotated, and a linking slot extending in the longitudinal direction of said arm, said leading end being engageable with the slot of said tongue in said insertion passage;

driving means for turning said arm in the tongue inserting direction, said driving means including a solenoid having an iron core capable of moving in the tongue inserting direction when the solenoid is energized, and a link engaging said linking slot and moving back and forth in the tongue inserting direction according to movement of the iron core by operation of said solenoid, a first sensor for detecting a leading end of said tongue inserted into an entrance of said insertion passage;

a second sensor for detecting that said tongue has been inserted into a latch position;

actuation means for actuating said driving means in response to a detection signal of said first sensor and for stopping said driving means in response to a detection signal of said second sensor; and latch releasing means for retracting said latch pawl from said inserting passage, said latch releasing means including a lever extending from said latch pawl, a cam wheel engaging a leading end of said lever for moving said latch pawl back and forth relative to said tongue insertion passage, and a pitch mechanism for associating the iron core of said solenoid and said cam wheel and rotating the cam wheel at a predetermined angle for each stroke of said iron core so that forward and backward movements of said latch pawl into and out of said tongue insertion passage are switched for said each stroke so that when said tongue is inserted into the insertion passage, said leading end of said arm is brought into said insertion passage by said driving means, the leading end comes into the slot of said tongue, and said tongue is pulled along said insertion passage and latched by said latch pawl.

2. A seat belt tongue retaining device according to claim 1, wherein said pitch mechanism includes:

pins formed on said cam wheel in circumferentially equal-distant positions; and a feed rod having one end which is pivoted to said link and the other end which is provided with a pawl engaging with one of said pins.

3. A seat belt tongue retaining device according to claim 1, further comprising a manual latch releasing mechanism for retracting said latch pawl manually from said tongue insertion passage.

4. A seat belt tongue retaining device comprising:

a tongue having a latch hole, and a slot formed at a side of the latch hole and extending in a tongue inserting direction;

a buckle unit having an insertion passage therein and a latch pawl capable of getting into and out of said insertion passage;

an arm for pulling the tongue along the insertion passage, said arm being formed inside the buckle and having a base end about which the arm is rotated, and a leading end capable of protruding into the tongue insertion passage and moving in the tongue inserting direction, said leading end being engageable with the slot of said tongue in said insertion passage;

driving means situated in the buckle unit and engaging the arm for pulling the arm in the tongue inserting direction; and a first sensor situated in the buckle unit and located at an entrance of the insertion passage, said first sensor, when the tongue is located at the entrance of the insertion passage, actuating the driving means so that the leading end of said arm is brought into the insertion passage, enters into the slot of the tongue, and pulls the tongue along said insertion passage into a latch position to thereby automatically engage the latch pawl with the latch hole.

5. A seat belt tongue retaining device according to claim 4, further comprising latch releasing means, said latch releasing means, when actuated, disengaging the latch pawl from the latch hole of the tongue and pushing the tongue from the insertion passage to thereby automatically disengage the tongue from the buckle unit.

6. A seat belt tongue retaining device according to claim 4, further comprising:

a second sensor for detecting that said tongue has been inserted into a latch position; and actuation means for actuating said driving means in response to a detection signal of said first sensor and for stopping said driving means in response to a detection signal of said second sensor.

7. A seat belt tongue retaining device according to claim 2, wherein said driving means includes:

a solenoid having an iron core capable of moving in the tongue inserting direction when the solenoid is energized;

a linking slot formed in said arm and extending in the longitudinal direction of said arm; and a link engaging with said linking slot and moving back and forth in the tongue inserting direction by movement of the iron core of said solenoid.

8. A seat belt tongue retaining device according to claim 4, further comprising latch releasing means driven by said driving means for retracting said latch pawl out of said insertion passage.

* * * * *